United States Patent [19]

Kakiuchi et al.

[11] Patent Number: 5,033,749

[45] Date of Patent: Jul. 23, 1991

[54] THREAD-WOUND GOLF BALL

[75] Inventors: Shinichi Kakiuchi, Yokohama; Seisuke Tomita, Tokorozawa, both of Japan

[73] Assignee: Bridgestone Corporation, Tokyo, Japan

[21] Appl. No.: 497,032

[22] Filed: Mar. 20, 1990

[30] Foreign Application Priority Data

Mar. 28, 1989 [JP] Japan ..... 1-7718

[51] Int. Cl.[5] ..... A63B 37/08

[52] U.S. Cl. ..... 273/227; 273/231

[58] Field of Search ..... 273/231, 220, 221, 222, 273/225, 226, 227, 228, 229, 230, 62

[56] References Cited

U.S. PATENT DOCUMENTS 3,490,770 1/1970 Satchell et al. ..... 273/231

FOREIGN PATENT DOCUMENTS 645311 10/1950 United Kingdom ..... 273/231

655525 7/1951 United Kingdom ..... 273/231

*Primary Examiner*—George J. Marlo

*Attorney, Agent, or Firm*—Sughrue, Mion, Zinn Macpeak & Seas

[57] ABSTRACT

A thread-wound golf ball comprising; a liquid center having a diameter in the range of 26 to 30 mm and having a hollow spherical center backing with a liquid contained therein, a thread rubber layer, and a cover thereon, said center backing being formed of a rubber material selected from the group consisting of natural rubber and blends of natural rubber having a JIS A hardness of 44 to 58 and a thickness of 1.7 to 2.3 mm, said liquid having a specific gravity of 1.01 to 2.5, and said liquid center exhibiting a deflection of 10 mm under a load of 1 to 2 kg and a deflection of 15 mm under a load of 3 to 6.5 kg.

8 Claims, 2 Drawing Sheets

THREAD-WOUND GOLF BALL

This invention relates to thread-wound golf balls, more particularly, to golf balls in which thread rubber is wound on a liquid center to form a core ball which is enclosed in a cover.

BACKGROUND OF THE INVENTION

In the prior art, thread-wound golf balls are generally manufactured by winding a rubber thread having high elongation on a spherical liquid center to form a core ball, and then enclosing the core ball in a dimpled cover. Most liquid centers are hollow spherical center backing of rubber or the like having a hollow interior filled with water or a similar liquid containing a specific gravity modifier.

The general requirements for golf balls are an increased flying distance and ease of ball control. As compared with the two-piece golf balls, the thread-wound golf balls are increased in backspin and control but inferior in flying distance because the ball tends to lift due to the increased backspin.

There is a need for a thread-wound golf ball capable of providing a longer flying distance. It might be contemplated to increase the initial speed of the ball upon impact by increasing the impact resilience of thread rubber wound thereon. Since the initial speed of golf balls, however, is strictly restricted by the rules of the Professional Golfers, Association, a certain limit is imposed on the flying distance which can be increased by increasing the initial speed of the ball.

SUMMARY OF THE INVENTION

Therefore, an object of the present invention is to provide a novel and improved thread-wound golf ball which can afford an increased flying distance while offering an initial speed within the acceptable range and maintaining ease of control.

To achieve this and other objects, the inventors investigated the nature of a liquid center of a thread-wound golf ball in relation to the flying distance and backspin thereof. The deflection of a liquid center was measured by applying a load thereto. Most liquid centers of the conventional thread-wound golf balls are required to apply a load of more than 2.5 kg to provide a deflection of 10 mm and a load of more than 7 kg to provide a deflection of 15 mm. This range of hardness induced more backspin, resulting in a loss of flying distance. Quite unexpectedly, the inventors have found that when the liquid center is made soft enough to require a load of up to 2.5 kg to provide a deflection of 10 mm and a load of up to 7 kg to provide a deflection of 15 mm, it becomes possible to reduce the backspin without losing controllability and to extend the flying distance without increasing the initial speed. The present invention is based on this finding.

According to the present invention, there is provided a thread-wound golf ball comprising a liquid center, a thread rubber layer, and a cover thereon, wherein the liquid center exhibits a deflection of 10 mm under a load of up to 2.5 kg and a deflection of 15 mm under a load of up to 7 kg.

The liquid center used in the golf ball of the invention is softer than the conventional liquid centers. Then a smaller load is required to deform the present liquid center by a certain amount than in the conventional liquid centers. The present ball produces a reduced backspin of the order of 3,700 to 3,900 rpm while the backspin of the conventional balls is of the order of 4,100 to 4,300 rpm. As a result, the flying distance of the present ball is increased.

BRIEF DESCRIPTION OF THE DRAWINGS

The above and other objects, features, and advantages of the present invention will be better understood from the following description taken in conjunction with the accompanying drawings, in which.

DETAILED DESCRIPTION OF THE INVENTION

Figure 1:
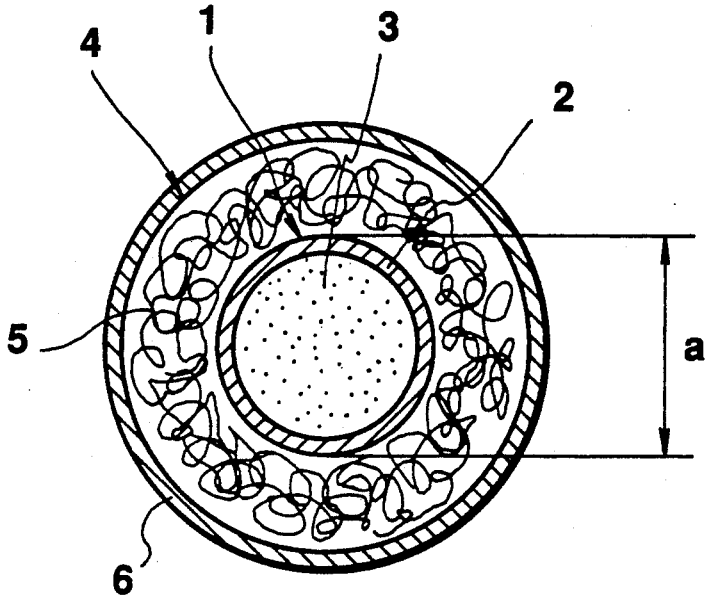
FIG. 1 is a schematic cross-section of a thread-wound golf ball according to one embodiment of the present invention.

Referring to FIG. 1, there is illustrated in cross section a thread-wound golf ball according to one embodiment of the present invention. The golf ball includes a spherical liquid center 1 in the form of a hollow spherical center backing 2 having a hollow interior filled with a liquid 3. Thread rubber 5 is wound on the liquid center 1 to form a core ball 4. The core ball 4 is enclosed in a cover 6 having a multiplicity of dimples on the outer surface thereof (not shown).

Figure 2:
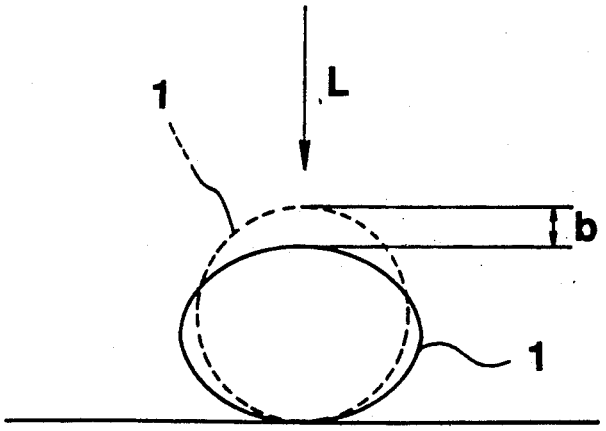
FIG. 2 illustrates a liquid center before and after deflection under a load.

In the golf ball of the invention, the liquid center 1 exhibits a deflection of 10 mm under a load of up to 2.5 kg and a deflection of 15 mm under a load of up to 7 kg. That is, the liquid center 1 is formed such that the load required to provide a deflection of 10 mm (to be referred to as 10-mm deflection load, hereinafter) is up to 2.5 kg. At the same time, the load required to provide a deflection of 15 mm (to be referred to as 15-mm deflection load, hereinafter) is up to 7 kg. When a vertical load L is applied to the liquid center 1 on a horizontal base as shown in FIG. 2, the liquid center produces a deflection b in a vertical diametrical direction. The terms 10- and 15-mm deflection loads are the loads L applied to produce a deflection b of 10 and 15 mm, respectively.

The 10-mm deflection load is preferably in the range of from 1 to 2.5 kg, more preferably in the range of from 1.5 to 2 kg. The 15-mm deflection load is preferably in the range of from 3 to 7 kg, more preferably in the range of from 4 to 6.5 kg. If the liquid center 1 is too soft, the associated ball produces only an extremely low backspin and loses controllability upon iron shots.

Preferably, the liquid center 1 has an outer diameter a (see FIG. 1) in the range of from 26 to 30 mm.

The liquid 3 contained in the liquid center 1 of the golf ball of the invention is not particularly limited. Any conventional liquid composition may be used such that the liquid 3 has a specific gravity in the range of from 1.0 to 2.5. A typical liquid composition is water having added thereto a specific gravity modifier such as $BaSO_4$ and $SiO_2$.

In the practice of the invention, the softness of the liquid center 1 is primarily regulated by varying the material and hardness of the center backing 2 filled with the liquid 3. The material of the center backing 2 is not particularly limited. Most preferably, the center backing 2 is formed of a rubber material having a JIS A hardness of 44 to 58 to a thickness of 1.7 to 2.7 mm because the resulting liquid center 1 exhibits best performance. Examples of the rubber material include natural rubber, blends of natural rubber and polybutadiene rubber, and blends of natural rubber and polyisoprene rubber.

The thread rubber 5 to be wound around the liquid center 1 in the practice of the invention may be selected from well-known rubbers such as natural rubber and isoprene rubber. The cover 6 may be selected from well-known covering materials such as balata and ionomer resins. The cover 6 usually has a thickness of 1.5 to 2.3 mm.

The invention achieves an increase in flying distance due to a moderate loss of backspin. This improvement is further enhanced by a proper choice of dimples on the cover 6. More particularly, the flying distance can be further increased by arranging 300 to 600 dimples, more preferably 340 to 450 dimples such that the percent area occupied by the dimples (that is, total dimple surface area/ball surface area×100%) may be at least 72%, preferably at least 76%, more preferably at least 80%. Better results are obtained when the percent volume occupied by the dimples (that is, total dimple volume/ball volume×100%) is in the range of from 0.8 to 1%, especially from 0.85 to 0.9%.

Preferred dimple arrangements are regular icosahedral, regular dodecahedral, and regular octahedral arrangements. The dimples may preferably be distributed uniformly on the ball surface in such an arrangement.

The present invention may be applied to any type of golf ball including small balls having a diameter of at least 41.15 mm and a weight of up to 45.92 g, and large balls having a diameter of at least 42.67 mm and a weight of up to 45.92 g.

EXAMPLE

Examples of the invention are given below by way of illustration and not by way of limitation.

EXAMPLES 1-9

Thread-wound golf balls of the configuration shown in FIG. 1 were manufactured by winding a rubber thread on a liquid center whose dimensions and nature are shown in Table 1, to form a core ball having a diameter of 38.1 mm. The core ball was enclosed in a cover by placing the ball in a pair of semi-spherical balata shells of 2.3 mm thick and shaping the cover under pressure followed by vulcanization. Table 1 also reports the parameters associated with dimples as well as the weight and hardness of the balls.

Figure 3:
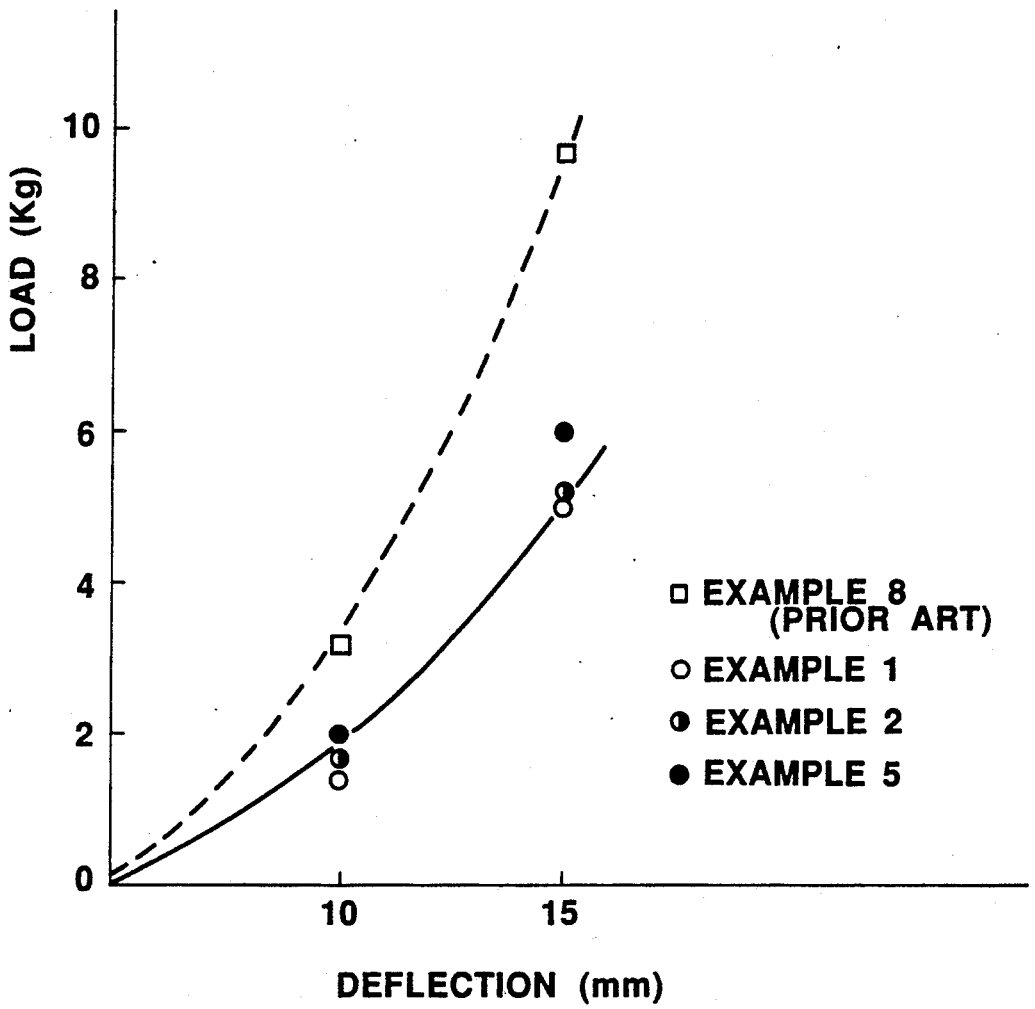
FIG. 3 is a diagram showing load-deflection curves of various liquid centers.

FIG. 3 shows the load-deflection curves of the liquid centers used in Examples 1, 2, 5, and 8 (prior art).

The golf balls were measured for initial speed, backspin, carry, and total flying distance. The results are also shown in Table 1.

TABLE 1

| | Example | | | | | | | | |
|---|---|---|---|---|---|---|---|---|---|
| | 1 | 2 | 3 | 4 | 5 | 6 | 7 | 8* | 9* |
| Liquid center | | | | | | | | | |
| Liquid center diameter, mm | 27.9 | 28.1 | 28.1 | 28.1 | 28.0 | 28.0 | 27.9 | 28.0 | 28.1 |
| Centerback thickness, mm | 1.7 | 2.0 | 2.0 | 2.0 | 2.3 | 2.3 | 1.7 | 2.3 | 2.0 |
| Centerback hardness, JIS A | 51 | 51 | 51 | 51 | 48 | 48 | 56 | 62 | 59 |
| 10-mm deflection load(1), kg | 1.4 | 1.6 | 1.6 | 1.6 | 1.8 | 1.8 | 1.9 | 3.1 | 2.5 |
| 15-mm deflection load(1), kg | 5.0 | 5.1 | 5.1 | 5.1 | 6.0 | 6.0 | 5.8 | 9.7 | 7.0 |
| Dimples | | | | | | | | | |
| Number | 392 | 392 | 432 | 432 | 360 | 390 | 432 | 390 | 390 |
| Dimple occupied surface, % | 84 | 84 | 80 | 75 | 75 | 73 | 75 | 73 | 73 |
| Dimple occupied volume, % | 0.85 | 0.85 | 0.89 | 0.87 | 0.89 | 0.89 | 0.87 | 0.89 | 0.89 |
| Ball | | | | | | | | | |
| Weight, gram | 45.4 | 45.5 | 45.5 | 45.3 | 45.4 | 45.4 | 45.5 | 45.4 | 45.3 |
| Hardness(2), mm | 2.44 | 2.40 | 2.53 | 2.50 | 2.60 | 2.53 | 2.51 | 2.60 | 2.58 |
| Performance(3) | | | | | | | | | |
| Initial speed, m/sec. | 65.8 | 65.9 | 65.8 | 65.8 | 65.7 | 65.8 | 65.8 | 65.7 | 65.9 |
| Backspin, ppm | 3710 | 3820 | 3830 | 3830 | 3900 | 3890 | 3850 | 4200 | 4100 |
| Carry, m | 208.8 | 208.3 | 208.2 | 207.8 | 206.9 | 206.3 | 207.8 | 205.0 | 205.8 |
| Total distance, m | 220.4 | 220.0 | 220.1 | 219.8 | 219.5 | 218.4 | 219.6 | 216.0 | 217.1 |

*outside the scope of the invention
(1)Instron compression tester
(2)measured under a constant load of 100 kg
(3)measured by hitting with a hitting machine at a head speed of 45 m/sec.

Table 1 reveals that the golf balls of the invention are reduced in backspin and increased in flying distance as compared with the prior art balls (Examples 8 and 9).

There has been described a thread-wound golf ball having a controlledly soft liquid center, which is reduced in backspin without losing ease of control. That is, increased in flying distance without increasing the initial speed is attained.

Although some preferred embodiments have been described, many modifications and variations may be made thereto in the light of the above teachings. It is therefore to be understood that within the scope of the appended claims, the invention may be practiced otherwise than as specifically described.

We claim:

1. A thread-wound golf ball comprising; a liquid center having a diameter in the range of 26 to 30 mm and having a hollow spherical center backing with a liquid contained therein, a thread rubber layer, and a cover thereon, said center backing being formed of a rubber material selected from the group consisting of natural rubber, and blends of natural rubber and having a JIS A hardness of 44 to 58 and a thickness of 1.7 to 2.3 mm, said liquid having a specific gravity of 1.0 to 2.5, and said liquid center exhibiting a deflection of 10 mm under a load of 1 to 2 kg and a deflection of 15 mm under a load of 3 to 6.5 kg.

2. The thread-wound golf ball of claim 1 wherein said liquid comprises water having a specific gravity modifier.

3. The thread-wound golf ball of claim 2 wherein said specific gravity modifier comprises $BaSO_4$.

4. The thread-wound golf ball of claim 2 wherein said specific gravity modifier comprises $SiO_2$.

5. The thread-wound golf ball of claim 1 wherein said cover comprises balata.

6. The thread-wound golf ball of claim 1 wherein said cover comprises an ionomer resin.

7. The thread-wound golf ball of claim 1 wherein said thread rubber comprises natural rubber.

8. The thread-wound golf ball of claim 1 wherein said thread rubber comprises polybutadiene rubber.

* * * * *